US006851882B1

(12) United States Patent
Maloney

(10) Patent No.: US 6,851,882 B1
(45) Date of Patent: Feb. 8, 2005

(54) DISPOSABLE TOOTHBRUSH WITH RESERVOIR

(76) Inventor: Ray Andrew Maloney, 2420 Fogarty Dr., Key West, FL (US) 33040

( * ) Notice: Subject to any disclaimer, the term of this patent is extended or adjusted under 35 U.S.C. 154(b) by 0 days.

(21) Appl. No.: 10/632,395

(22) Filed: Jul. 31, 2003

(51) Int. Cl.[7] ..... A46B 11/02
(52) U.S. Cl. ..... 401/183; 401/288; 401/289
(58) Field of Search ..... 401/184, 183, 401/288, 289

(56) References Cited

U.S. PATENT DOCUMENTS

| | | | | |
|---|---|---|---|---|
| 611,788 | A | | 10/1898 | Lincoln |
| 1,014,784 | A | | 1/1912 | Tate |
| 1,317,437 | A | | 9/1919 | Drury |
| 1,343,570 | A | | 6/1920 | Lieberthal |
| 1,486,394 | A | | 3/1924 | Smith |
| 1,578,922 | A | | 3/1926 | Sargery |
| 1,610,831 | A | | 12/1926 | Wallace |
| 1,811,833 | A | | 3/1931 | Simon |
| 2,370,626 | A | | 3/1945 | Heidman |
| 2,438,641 | A | | 3/1948 | Loehr |
| 2,550,190 | A | | 4/1951 | Greenberg |
| 2,705,335 | A | * | 4/1955 | Glassman et al. ..... 401/184 |
| 2,766,472 | A | | 10/1956 | Durrett |
| 2,932,044 | A | | 4/1960 | Woodrow |
| 2,948,007 | A | | 8/1960 | Tanguay |
| 3,070,102 | A | | 12/1962 | MacDonald |
| 3,148,684 | A | | 9/1964 | Kisler |
| 3,165,776 | A | | 1/1965 | Tuseth |
| 3,256,894 | A | * | 6/1966 | Sherman ..... 401/271 X |
| 3,432,245 | A | | 3/1969 | Fludson |
| 3,691,585 | A | | 9/1972 | Flom |
| 3,738,761 | A | | 6/1973 | Segerstad |
| 4,062,635 | A | | 12/1977 | Teh-Sheng |
| 4,198,171 | A | | 4/1980 | Lampka |
| 4,199,270 | A | | 4/1980 | Tomasini |
| 4,375,924 | A | | 3/1983 | Lemire |
| 4,530,129 | A | | 7/1985 | Labick et al. |
| 4,865,481 | A | | 9/1989 | Scales |
| 5,040,553 | A | | 8/1991 | Londono et al. |
| 5,066,155 | A | | 11/1991 | English et al. |
| 5,490,530 | A | | 2/1996 | Snowden |
| 5,584,593 | A | | 12/1996 | Lafortune |
| 5,599,126 | A | * | 2/1997 | Hough ..... 401/184 |
| D392,101 | S | | 3/1998 | Travesi |
| 5,755,523 | A | | 5/1998 | Seydel |
| 5,893,378 | A | | 4/1999 | Llerena |
| 6,135,274 | A | | 10/2000 | James |
| D440,049 | S | | 4/2001 | De Mond et al. |
| 6,244,777 | B1 | | 6/2001 | Reid |
| D459,585 | S | | 7/2002 | Moreno et al. |

* cited by examiner

*Primary Examiner*—Gene Mancene
*Assistant Examiner*—Kathleen J. Prunner
(74) *Attorney, Agent, or Firm*—Peter Loffler

(57) ABSTRACT

A disposable toothbrush with reservoir can be used once or at most a handful of times and has a handle with a top surface and a bottom surface and a head attached thereto, the head having bristles thereon. A reservoir having toothpaste therein is disposed within the top surface of the handle and may extend through to the bottom while one or two covers cover the reservoir. The top cover can be removable in order to provide access to the toothpaste within the reservoir or the one or two covers act as bladders for feeding the toothpaste through a duct and an opening to the bristles or along a channel extending between the reservoir and the bristles.

8 Claims, 3 Drawing Sheets

DISPOSABLE TOOTHBRUSH WITH RESERVOIR

BACKGROUND OF THE INVENTION

1. Field of the Invention

The present invention relates to a limited use disposable toothbrush having a reservoir integral therewith, the reservoir holding toothpaste therein.

2. Background of the Prior Art

Most often, people brush their teeth at home or at a home away from home such as a hotel room or a cruise ship cabin. However, there are many times that it is desirable to brush teeth when a person is not at home. Just prior to a business meeting, during a day long hike through the woods, and on a cross country airplane flight, are but a few examples when it may be desirable to brush ones teeth. However, in many such situations it is not very feasible or convenient to carry a toothbrush and a tube of toothpaste, even a travel sized tube, in order to be able to brush the teeth.

In order to address the need to be able to brush teeth at times and at locations where the provision of a tube of toothpaste is not very convenient, devices have been proposed wherein a toothbrush has a reservoir associated therewith, which reservoir holds an amount of toothpaste therein. When brushing of the teeth is desired, the toothpaste is retrieved from the reservoir, applied to the bristles of the toothbrush, and the user's teeth are brushed accordingly. Such devices fall into one of two broad categories.

The first type of toothbrush with reservoir is a refillable type wherein the reservoir is replenished upon becoming empty. Such a toothbrush is designed to be used until the bristles wear out through normal brushing use at which point the entire brush is discarded in normal fashion. The problem associated with this type of toothbrush with reservoir is that, by nature, the toothbrush is designed to travel with the user. In such a setting the bristles become dirty over time simply from being exposed in the environment within which a user uses such a brush and the brush becomes undesirable for use. Additionally, a toothbrush with reservoir must be relatively compact in order to be effective. As toothpaste has a very low viscosity, refilling the necessarily relatively small reservoir can prove to be quite a challenge. In addition, over time, the toothpaste within the brush becomes hardened, making it necessary to clean the inner workings of the brush, which may prove to be a major challenge, or some of the hardened toothpaste makes its way onto the bristles, making brushing less than desirable. In some situations, the toothbrush can become so clogged that it must be prematurely discarded.

The other category of a toothbrush with reservoir is a disposable toothbrush. In such a configuration, the reservoir is loaded with an amount of toothpaste that is sufficient for one or at most a small handful of brushings, and upon the exhaustion of the toothpaste supply, the toothbrush is discarded and a new brush is obtained. Such a toothbrush overcomes the difficulties of refilling the reservoir as well as keeping the workings of the toothbrush clean. However, one problem that affects this category of toothbrush with reservoir, is that many prior art devices are unusually complex in design and construction, making such devices relatively expensive to produce. Although this is a problem that also affects many refillable toothbrushes, the fact that this category of toothbrush is disposable after a very limited working life span, tends to shy many consumers away from purchasing such devices due to the high cost of such a device. Although some devices have been proposed that have little or no moving parts so as to be simple in design and construction, such prior art devices make loading of the toothpaste onto the bristles of the toothbrush difficult. Further, such devices, while oftentimes are loaded with sufficient toothpaste for 3–5 typical uses, may fail after just one or two uses due to clogging of the toothpaste feeder system of the brush.

Therefore, there exists a need in the art for a disposable toothbrush that addresses the above-mentioned problems in the art. Specifically, such a toothbrush must be relatively simple in design and construction so that the toothbrush is relatively inexpensive, in order that the cost does not prove to be a burden to the target market. Additionally, such a toothbrush must allow the transfer of the toothpaste from the reservoir to the bristles to be a relatively simple and straightforward task. If the toothbrush is designed for more than a single use, the device must assure that it does not become easily inoperational prior to the exhaustion of the toothpaste supply within the reservoir.

SUMMARY OF THE INVENTION

The disposable toothbrush with reservoir of the present invention addresses the aforementioned needs in the art. Specifically, the disposable toothbrush with reservoir is relatively simple in design and construction so that the toothbrush is relatively inexpensive. The cost to produce the disposable device is not an undue burden to the target market. The disposable toothbrush with reservoir allows the transfer of the toothpaste from the reservoir to the bristles to be a relatively simple and straightforward task. The present invention is designed for both single use as well as multiple use, and in a multiple use embodiment, the device does not become easily inoperational prior to the exhaustion of the toothpaste supply within the reservoir.

The disposable toothbrush with reservoir of the present invention is comprised of a handle having a first top surface and a first bottom surface. A head having a second top surface and a second bottom surface is connected to the handle, while a plurality of bristles extend upwardly from the second top surface of the head. A reservoir having toothpaste therein, is located within the handle, advantageously within the first top surface of the handle, while a first cover covers the reservoir, the first cover being either removable or acting as a bladder. If the reservoir extends through to the first bottom surface, a second cover covers the reservoir at the first bottom surface and the first cover and the second cover act as a bladder system A tab may be attached to the first cover for facilitating removal of the first cover from a covering relationship with the reservoir, if the first cover is not a bladder. At least a portion of the bristles may be ramped downwardly toward the handle. An opening is disposed within the second top surface of the head while a duct connects the opening with the reservoir. Placement of pressure on the first cover and the second cover (if used) causes the toothpaste within the reservoir to pass through the duct and exit through the opening. The duct is disposed along a longitudinal axis of the handle. Alternately, a channel may extend between the reservoir and the bristles such that the toothpaste passes along the channel and to the bristles. The channel may be located on either surface of the toothbrush.

BRIEF DESCRIPTION OF THE DRAWINGS

Similar reference numerals refer to similar parts throughout the several views of the drawings.

DESCRIPTION OF THE PREFERRED EMBODIMENT

Figure 1:
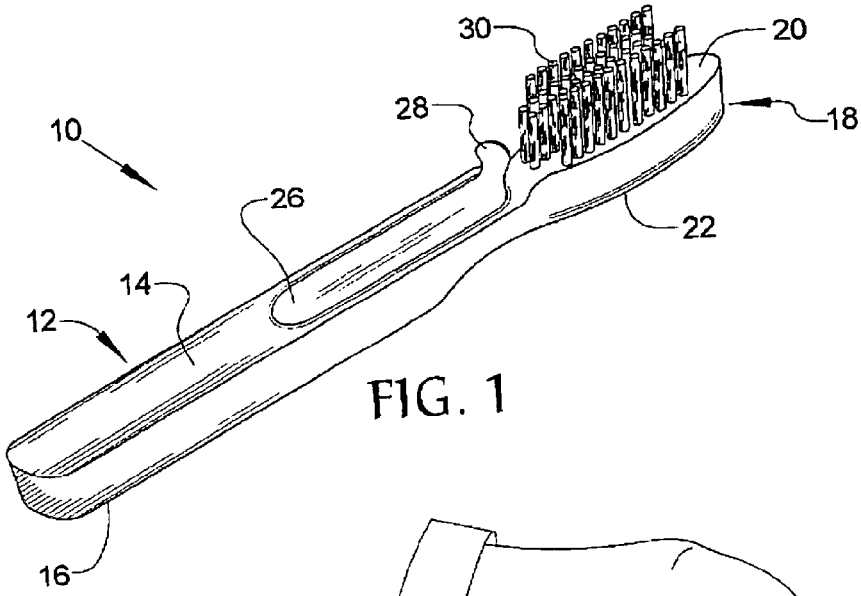
FIG. 1 is a perspective view of the toothbrush with reservoir.
Figure 2:
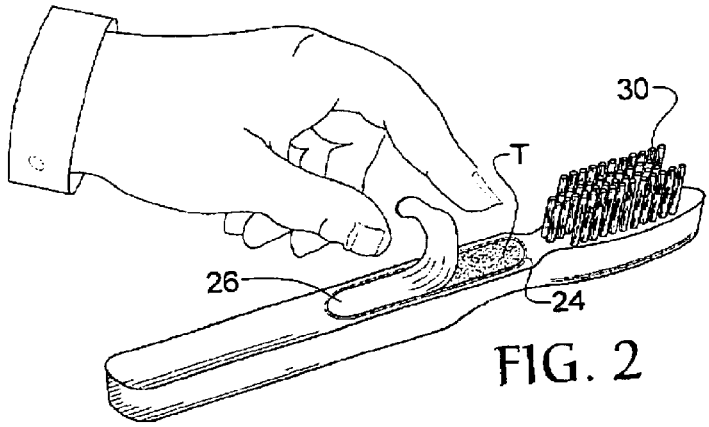
FIG. 2 is a perspective view of the toothbrush with reservoir with the protective cover partially lifted.
Figure 3:
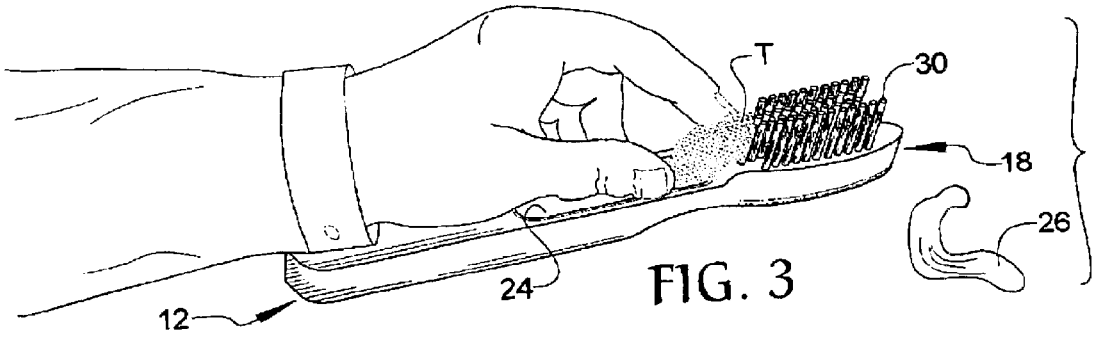
FIG. 3 is a perspective view of the toothbrush with reservoir with the toothpaste being pushed onto the bristles.
Figure 4:
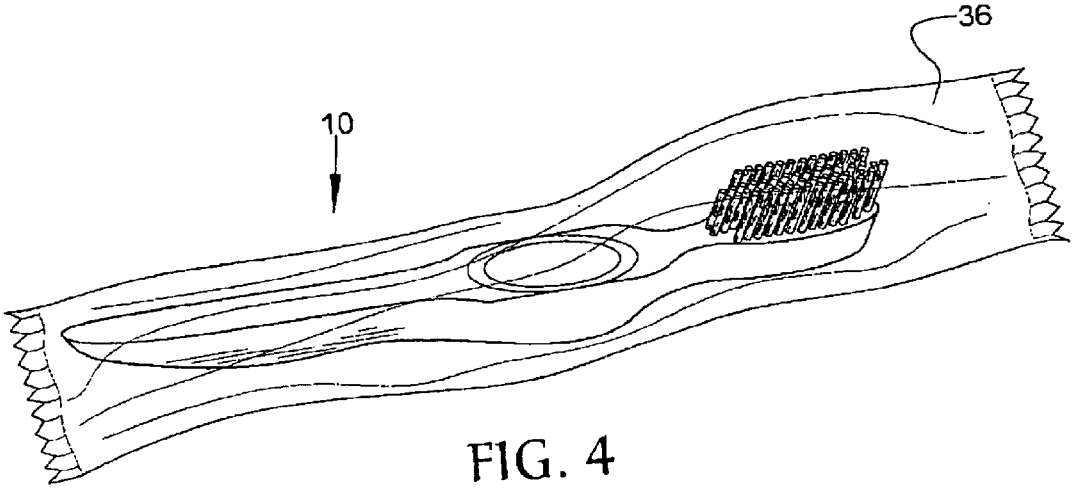
FIG. 4 is a perspective view of the toothbrush with reservoir disposed within a package.
Figure 5:
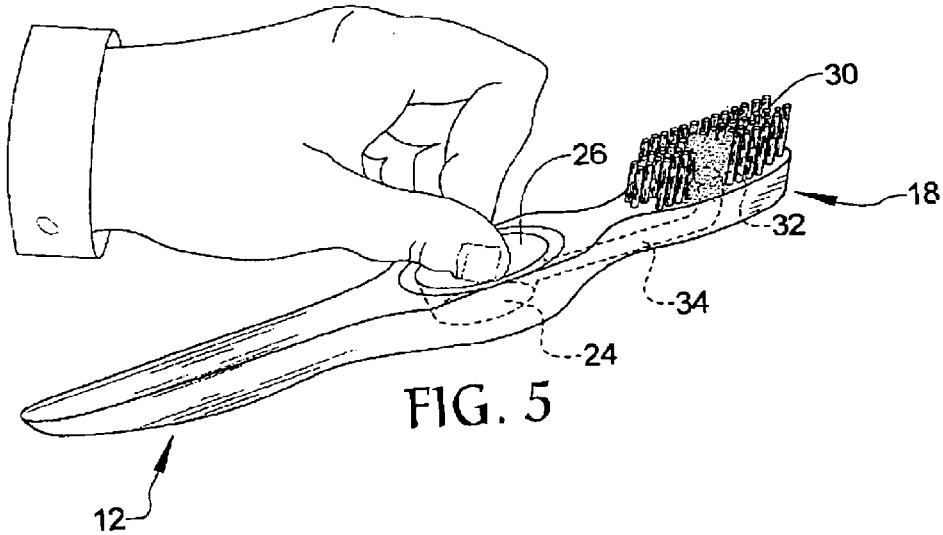
FIG. 5 is a perspective view of the toothbrush with reservoir having a duct and opening for feeding the toothpaste to the bristles.

Referring now to the drawings, it is seen that the toothbrush with reservoir of the present invention, generally denoted by reference numeral 10, is a comprised of a brush handle portion 12 with a top surface 14 and a bottom surface 16 and a head portion 18 also having a top surface 20 and a bottom surface 22, the head portion 18 attached to the handle portion 12. The handle 12 may be made from any appropriate material used to make a toothbrush such as plastic, although due to its limited life span, hard paper or card stock can also be used. As seen, the handle portion 12 has a reservoir 24 descending from the top surface 14, the reservoir 24 having toothpaste T therein. A first protective cover 26, which may be made from aluminum foil, flexible plastic, etc., covers the reservoir 24 and is adhered to the brush handle 12 around the reservoir's periphery. The first protective cover 26 may either be a pull away cover that is designed to be removed from a covering relationship with the reservoir 24 in order to gain access to the contents T within the reservoir, in which case, a tab 28 may be provided in order to help facilitate removal of the first cover 26 from the handle 12, or the first cover 26 may act as a bladder for facilitating passage of the toothpaste T within the reservoir through either a duct system or a channel, each described below.

As seen, bristles 30 are located on the head portion 18 of the brush 10. The bristles 30 may be of any appropriate construction and configuration known in the art, and if the disposable toothbrush with reservoir 10 uses a pull away cover, at least a portion of the bristles 30 may be ramped downwardly toward the reservoir 24 in order to help facilitate toothpaste mounting onto the bristles 30.

A first opening 32 may be disposed within the top surface 20 of the head portion 18, while a duct 34 connects the reservoir 24 with this first opening 32.

The disposable toothbrush with reservoir 10 may be packaged in a protective device such as a box or cellophane 36 during shipment and when placed on sale. The use of an airtight package is necessary when the toothbrush 10 has an opening 32, otherwise, the toothpaste T within the reservoir will dry out.

Figure 6:
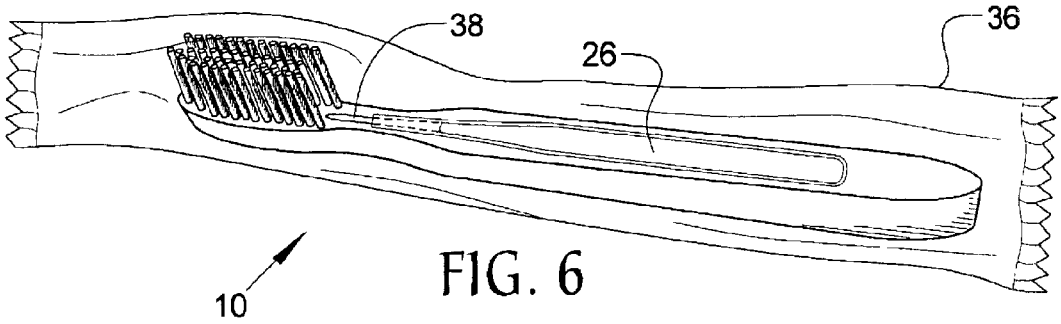
FIG. 6 is a perspective view of an alternate embodiment the toothbrush with reservoir disposed within a package.
Figure 7:
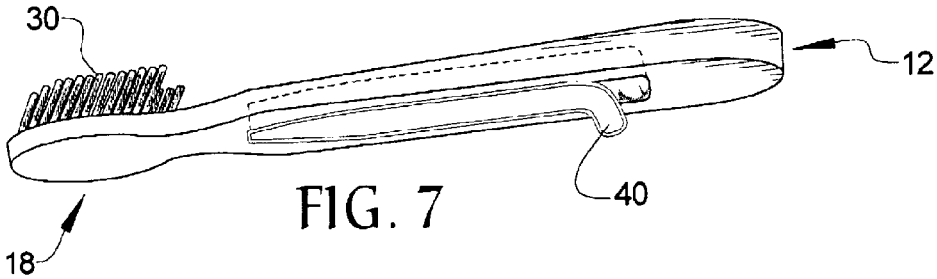
FIG. 7 is a bottom perspective view of the alternate embodiment of the toothbrush with reservoir, with the second cover partially removed for illustrative purposes.
Figure 8:
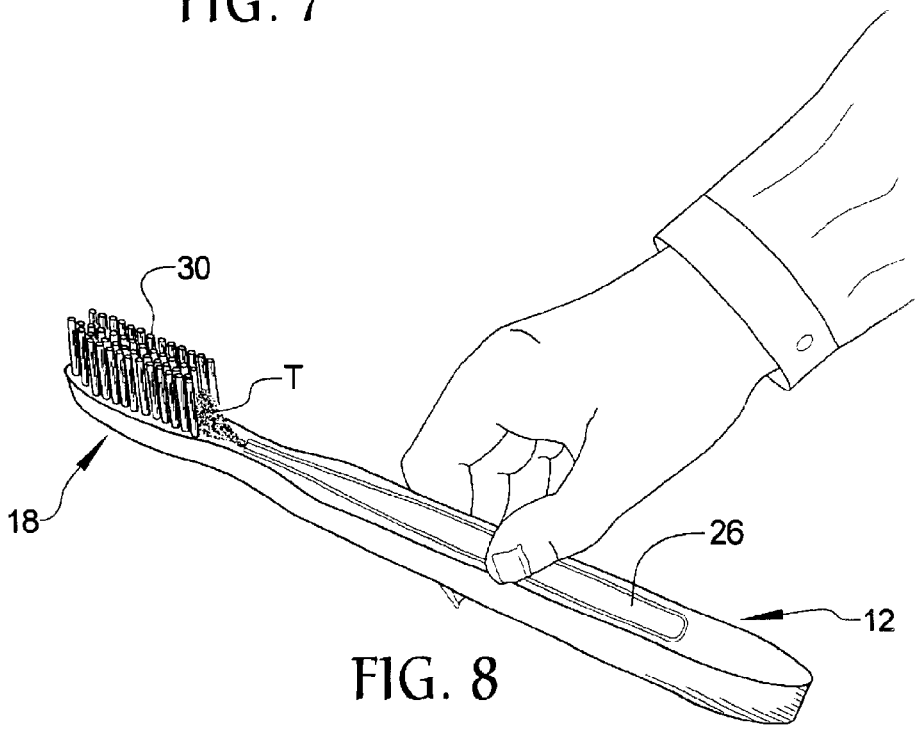
FIG. 8 is a top perspective view of the alternate embodiment of the toothbrush with reservoir.

A seen in FIGS. 6–8, a channel 38 may be disposed on the top surface 14 of the handle portion 12 in order to connect the reservoir 24 with the bristles 30. Toothpaste T is guided into and within the channel 38 in pushing the toothpaste from the reservoir 24 to the bristles 30 (if the duct 34 system is not used), the first cover 26 terminating at the channel 38. If desired, a tab cover covers the portion of the channel 38 beyond the first cover 26 in order to protect the toothpaste T from drying out. As further seen, the reservoir 24 may extend through to the bottom surface 16. As such, the reservoir 24 is covered by a second cover 40 on the bottom surface 16 of the handle portion 12. The first cover 26 and the second cover 40 act as bladders that push the toothpaste T from the reservoir 24 through the channel 38 (or duct 34) and to the bristles 30.

In order to use the toothbrush with reservoir 10 of the present invention, the brush 12 is retrieved from its protective packaging 36 and the first protective cover 26 is grasped by the tab 28 and peeled back in order to expose the toothpaste T within the reservoir 24. If desired, the first protective cover 26 may be completely removed. A user pushes, with a thumb or an appropriate instrument, the toothpaste T out of the reservoir 24 and onto the bristles 30. If provided, the channel 38 helps guide the toothpaste T between the reservoir 24 and the bristles 30. If the bristles 30 are ramped, the ramping helps facilitate the placement of the toothpaste T onto the bristles 30. The user uses the toothbrush 10 in normal fashion and once the user is finished brushing with the device 10, it is simply discarded in appropriate fashion. Another toothbrush with reservoir 10 is retrieved for the next brushing operation.

Alternately, the toothbrush 10 is removed from its protective package 36, the tab cover is removed, and pressure is placed onto the first protective cover 26 and second protective cover 40, if provided. This pressure causes the toothpaste T within the reservoir 24 to be squeezed through the duct 34 and out through the opening 32 wherein the toothbrush 10 is used by the user to brush teeth. Advantageously, only a single opening 32 is provided and the duct 34 is generally straight along its length, only curving upwardly toward the opening 32. This is necessary due to the low viscosity of toothpaste T. Use of multiple openings requires the use of branching and manifolding within the relatively small confines of a toothbrush handle and such branching and manifolding may make it extremely difficult to push toothpaste through to the openings. Even if sufficient pressure can be exerted, a large portion of the toothpaste may shoot out of the openings and onto the ground, missing the bristles entirely. Alternately, the pressure placed on the first cover 26 and the second cover 40 causes the toothpaste T to be squeezed out of the reservoir 24 and along the channel 38 to the bristles 30.

While the invention has been particularly shown and described with reference to embodiments thereof, it will be appreciated by those skilled in the art that various changes in form and detail may be made without departing from the spirit and scope of the invention.

I claim:

1. A toothbrush comprising:

a handle having a first top surface and an opposing first bottom surface;

a head having a second top surface and a second bottom surface, the head connected to the handle;

a plurality of bristles located on the second top surface of the head;

a reservoir having toothpaste therein located within the handle, the reservoir extending through to the first top surface and the first bottom surface;

a first removable cover positioned on the first top surface in order to cover the reservoir; and a second removable cover positioned on the first bottom surface in order to cover the reservoir.

2. The toothbrush as in claim 1 further comprising a tab attached to the first cover for facilitating removal of the first cover from a covering relationship with the reservoir.

3. The toothbrush as in claim 1 wherein at least a portion of the bristles are ramped downwardly toward the handle.

4. The toothbrush as in claim 1 further comprising a channel disposed on the first top surface of the handle and extending between the reservoir and the handle.

5. The toothbrush with reservoir as in claim 1 further comprising:

an opening disposed within the second top surface of the head;

a duct connecting the opening with the reservoir; and wherein placing pressure on the cover causes the toothpaste to pass through the duct and exit through the opening.

6. The toothbrush as in claim 5 wherein the duct is disposed along a longitudinal axis of the handle.

7. The toothbrush with reservoir as in claim 1 further comprising:

a single opening disposed within the second top surface of the head;

a duct connecting the opening with the reservoir; and wherein placing pressure on the cover causes the toothpaste to pass through the duct and exit through the opening.

8. The toothbrush as in claim 7 wherein the duct is disposed along a longitudinal axis of the handle.

* * * * *